US007438273B2

(12) United States Patent
Tota

(10) Patent No.: US 7,438,273 B2
(45) Date of Patent: Oct. 21, 2008

(54) ANCHOR FOR SECURING AN OBJECT TO GROUND

(76) Inventor: Michael Wayne Tota, 354 Greenwood Dr., Hermitage, PA (US) 16148

( * ) Notice: Subject to any disclaimer, the term of this patent is extended or adjusted under 35 U.S.C. 154(b) by 83 days.

(21) Appl. No.: 11/581,258

(22) Filed: Oct. 12, 2006

(65) Prior Publication Data

US 2007/0200046 A1 Aug. 30, 2007

Related U.S. Application Data

(60) Provisional application No. 60/777,360, filed on Feb. 28, 2006.

(51) Int. Cl.
*F16M 13/00* (2006.01)

(52) U.S. Cl. ..... 248/545; 248/530

(58) Field of Classification Search ..... 248/545, 248/156, 530, 508

See application file for complete search history.

(56) References Cited

U.S. PATENT DOCUMENTS

| | | | | |
|---|---|---|---|---|
| 4,858,876 | A | 8/1989 | Moreno | |
| 5,011,107 | A | 4/1991 | Reece | |
| 5,076,032 | A | 12/1991 | Lehman | |
| 5,098,057 | A * | 3/1992 | Gran et al. | 248/530 |
| 5,113,627 | A | 5/1992 | Jarrett | |
| 5,135,192 | A | 8/1992 | Winkler | |
| 5,400,997 | A | 3/1995 | Payne | |
| 5,568,909 | A * | 10/1996 | Timko | 248/519 |
| 5,649,690 | A | 7/1997 | Kilmer | |
| 6,202,368 | B1 | 3/2001 | Wallace | |
| 6,308,468 | B1 | 10/2001 | Caruso | |
| 6,336,620 | B1 * | 1/2002 | Belli | 248/519 |
| 6,343,446 | B1 | 2/2002 | Beard | |
| 6,461,084 | B1 | 10/2002 | Stuart | |
| 6,672,017 | B2 * | 1/2004 | Larson | 52/170 |
| 6,729,089 | B1 | 5/2004 | Spragg | |
| 6,745,990 | B2 | 6/2004 | Groff | |
| 6,938,871 | B1 * | 9/2005 | Carlson | 248/519 |
| 7,175,141 | B2 * | 2/2007 | Bolinder et al. | 248/156 |
| 2006/0157631 | A1 | 7/2006 | Cunningham | |
| 2006/0175595 | A1 | 8/2006 | Carnevali | |
| 2006/0180719 | A1 | 8/2006 | Cooper | |

* cited by examiner

*Primary Examiner*—Ramon O Ramirez

(57) ABSTRACT

The present invention describes an anchor for securing an object the ground. The anchor is especially useful for securing, either temporarily or permanently, fixing objects to the ground, such as signs, poles, mailbox posts, tent or net supports. Placement of the device requires no digging and few or no tools, and visible damage to the landscape is reduced. Advantageously, subterranean obstructions can be detected and avoided while securing the device to the ground, thereby protecting utility lines from damage. Typically, little strength and low torque is needed to secure the anchor to the ground.

18 Claims, 5 Drawing Sheets

ANCHOR FOR SECURING AN OBJECT TO GROUND

The present applicant claims priority to U.S. 60/777,360, which is hereby incorporated by reference.

FIELD OF THE INVENTION

The invention relates to anchoring device for securing an object to the ground. More particularly, the invention relates to an anchoring device that may be set, removed and reused with few or no tools.

BACKGROUND OF THE INVENTION

Posts, such as sign posts, fence posts, mailbox posts, etc., are typically set into the ground by digging a hole, placing the post in the hole, and filling the hole with concrete or compacted soil. The process is tedious and time-consuming, and below ground placement of a post can lead to rot or corrosion. Further, removal or repositioning of the post requires digging the post from the hole. The removal process can be even more difficult than initial placement.

Prior art includes a number of devices that facilitate placement or removal of a post. U.S. Pat. No. 5,400,997 describes a pre-fabricated anchoring base that may be set into the ground. A post may be securely yet removably set into the base. Disadvantageously, a hole must still be dug in the ground, the insert placed into the hole, and the hole backfilled with a suitable material. Digging scars the landscape, disrupts the land, requires replanting or reseeding, and dirt must be hauled away. Further, the post is still anchored below grade, so rot and corrosion could be problematic.

U.S. Pat. No. 6,308,468 teaches an anchor stake that is driven into the ground and over which a pole may be fitted. Digging of a hole is unnecessary, but a sledgehammer or other driver is needed to insert the stake. Variations on the anchor stake include U.S. Pat. Nos. 5,076,032, 6,745,990, 6,461,084 and 6,343,446, which include stakes having a plurality of fins for improved stability. The stakes are driven into the ground and provide a supporting platform for a post. The platform permits the post to rest above grade.

Another type of anchor includes a helical member that screws into the ground. U.S. Pat. No. 5,135,192 teaches a single helical rod fixedly secured, such as by welding, to a flat plate. The rod may be twisted into the ground until the flat plate rests on the ground. The plate may include means to attach a post to the plate. The single helical rod lacks lateral stability and can be lifted from the ground by sideways movement. Larger helical rods may be used to reduce this defect, but a large helical rod is more difficult to screw into the ground and may require a tool, such as a large wrench or pipe. Also, because the helical rod is fixedly secured to the plate, the plat would not be level and any post fixed to the plate would be out of plumb if the helical rod is screwed into the ground off perpendicular.

U.S. Pat. Nos. 6,202,368, 4,858,876, and 5,011,107 substitute a screw or auger for a helical rod. The screw or auger is fixedly attached a post mounting means. The larger cross-sections of the screw and auger demand greater power to drive the devices into the ground. A tool would probably be needed. Again, the fixed screw or auger could be inadvertently set so that the mounting means is out of plumb.

U.S. Pat. No. 5,113,627 teaches a sign and anchor apparatus. The sign includes a plurality of legs that penetrate the ground. The sign is set separately from the anchor, thereby facilitating vertical placement of the sign even if the anchor is out of plumb. The anchor includes an auger on a terminal end that is screwed into the ground. The other end of the anchor locks to the sign so that the sign cannot be easily pulled from the ground.

The above-described prior art, including the digging of holes or use of stakes, screws or augers, utilize rigid and often sharp points or edges forced into the ground. This requires the marking of utility services before placement. Failure to mark such services can result damage to the service line. Helical rods of the prior art do not necessarily have sharp points or edges, but only a large diameter rod provides sufficient holding power to secure a post to the ground. Such a large rod even lacking points or edges can damage a utility line.

A need exists for an anchoring device that securely yet removably fixes an object, such as a post, pole, or cable, to the ground, and does not pose a risk of damaging utility lines. The object could be plumbed regardless of the orientation of the anchors used to secure it to the ground. Advantageously, the anchoring device could be installed or removed without tools.

SUMMARY OF THE INVENTION

The present invention describes an anchor for removably fixing objects to the ground. Objects include, for example, posts, mailboxes, poles, and tie-outs. The anchor is especially useful for securely fixing, either temporarily or permanently, objects to the ground, such as signs, mailboxes, clothesline poles, tent supports, and sports nets. Placement of the anchor requires no digging and no special tools. Advantageously, subterranean obstructions can be detected and avoided while securing the anchor to the ground, thereby protecting utility lines from damage and causing no visible damage to the ground surface. Typically, the torque is needed to secure the anchor to the ground can be achieved using merely hands, a bar or wrench. A driving device, such as a sledgehammer, is unnecessary.

In a broad aspect, the anchor includes a base defining a plurality of holes. The base is set on the ground at the desired inclination. Fasteners pass through the holes and screw into the ground. The plurality of fasteners prevents the base from moving. The base prevents lateral movement of the fasteners that could weaken the holding power of the individual fasteners.

The base includes a central portion surrounded at least in part by a skirt. The central portion accepts and is shaped to receive the object. The central portion also comprises a retainer for the object. The retainer may be a flange, tenon or other mechanical connector. The skirt stabilizes the base and resists tipping. The size and shape of the skirt depends on the object to be secured. The skirt may include, for example, at least a portion of a disc or frusto-conical member surrounding the central portion. Alternatively, the skirt may include a plurality of legs. The skirt defines a plurality of holes through which the fasteners secure the base to the ground.

A fastener comprises a helical structure. The fastener may include a central shaft, such as a screw, or simply a helical coil. In one embodiment, the fastener should be flexible enough not to penetrate or sever utility lines. The flexibility of the fastener permits detection of subterranean obstacles, such as utility lines. In another embodiment, the fasteners may be screwed into the ground without tools. In still another embodiment, the fastener includes head. The head may be flattened or may define an eyelet. A wrench may be applied to the flattened head and the fastener screwed into the ground. An elongated object, such as a pipe, bar or screwdriver, may be inserted into the eyelet and the fastener screwed to the ground.

DETAILED DESCRIPTION OF THE INVENTION

Figure 1:
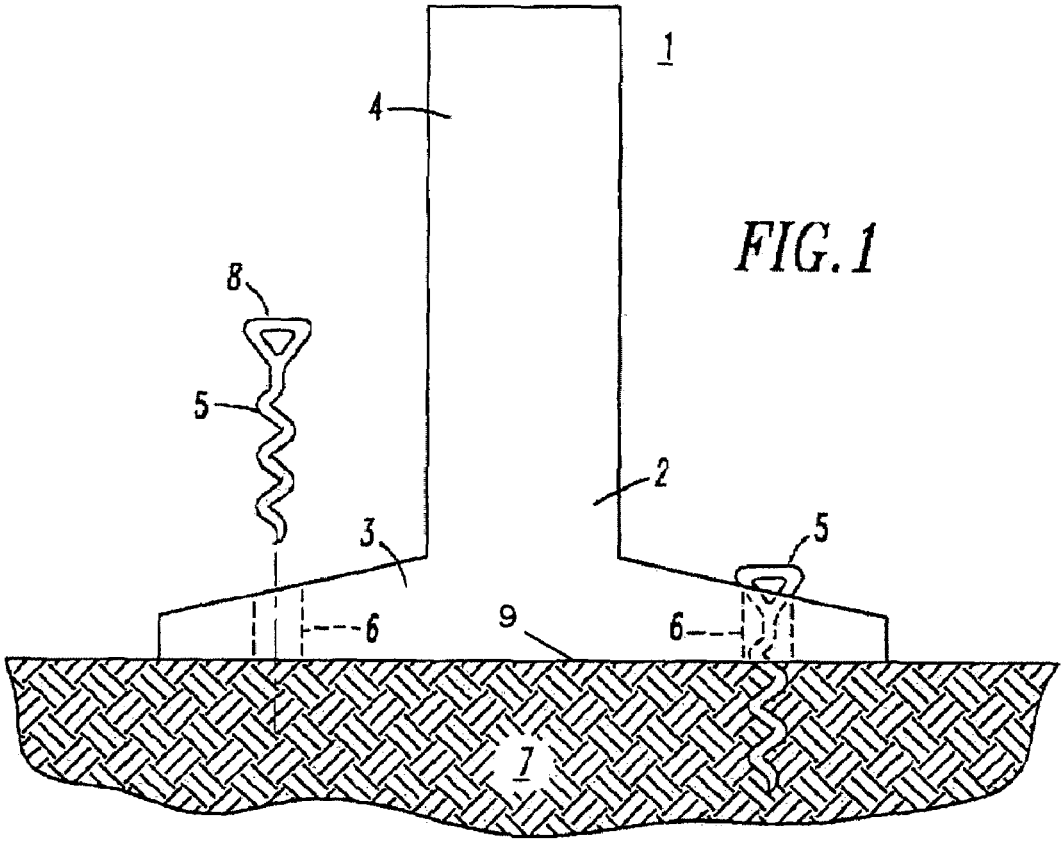
FIG. 1 is a side view of an anchor of the present invention.

FIG. 1 shows the anchor 1 of the present invention. The anchor 1 includes a base 2 and a plurality of fasteners 5. The base 2 includes a central portion 4 surrounded at least in part by a skirt 3. The central portion 4 is adapted to receive an object (not shown). The skirt 3 defines holes 6 through which fasteners 5 imbed in the ground 7, thereby securing the anchor 1. The base 2 reduces relative movement of the fasteners 5, thereby reducing lateral displacement that could lead to weakening of the fastener/ground contact.

The base 2 preferably has a flat bottom 7 so that the base 2 may be set on the ground to assure vertical positioning of the object. The base 2 may even include an integrated level. Unlike prior art, plumb may be set before the fasteners 5 secure the base 2 to the ground. The base 2 should comprise a rigid material, such as metal, wood or plastic. Plastic is resistant to corrosion and can be molded into a variety of shapes.

The skirt 3 at least partially surrounds the central portion 4 and may comprise at least a part of a disc, a plate, a frusto-conical element, or separate legs. The skirt 3 defines a plurality of holes 6. The holes 6 should be located for stability. For example, two holes may be placed on either side of the central portion 4 or three holes may be positioned equally surrounding the central portion 4. The holes 6 must be of sufficient size to permit the fasteners 5 to pass through. Each fastener 5 includes a head 8. When the fastener 5 is fully imbedded in the ground, the head 8 presses the skirt 3 against the ground 7. The fasteners 5 prevent the base 2 from moving while the fasteners 5 are set into the ground. The size of the skirt 3 will depend on its intended use. For example, when used as a post anchor for a mailbox, the skirt 3 should have a diameter at least about three times the width of the post. A larger diameter skirt 3 reduces tipping. A larger skirt would be necessary for larger or taller objects or for objects more prone to tipping.

The central portion 4 fixes the object to the base 2. The shape and size of the central portion 4 will vary depending of the object. For example, the central portion 4 may include at least one vertical flange to which the object may be fixed. The flange may have a hole adapted to receive a mechanical interlock. A solid post may be fitted into box formed by a plurality of vertical flanges. Alternatively, a mortise-tenon arrangement is suitable for hollow objects. The central portion 4 may have an interlock that prevents the object from lifting off the central portion. The interlock may be any mechanical structure or chemical that fixes the object the central portion. Interlocks include, for example, flanges, screws, bolts, rivets, glues, snaps, springs, etc. Preferably, the interlock permits the object to be removed. In one example, the central portion includes a flange defining a hole. A screw is placed through the hole and into the object.

Figure 2:
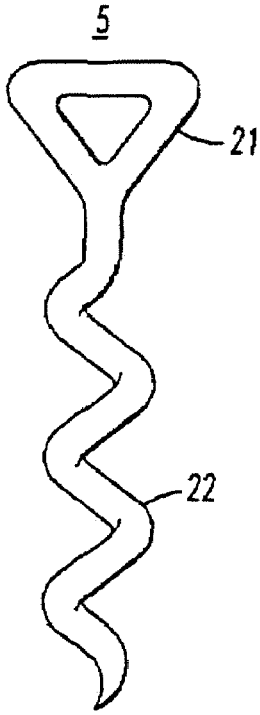
FIG. 2 is a side view of a helical coil.

As shown in FIG. 2, a fastener 5 comprises a helical portion 22 and a handle 21. The fastener 5 should consist essentially of a corrosion-resistant material. Preferred materials include stainless steel, galvanized steel, or engineering plastics. The helical portion 22 screws into the ground, and may include a central shaft, surrounded by a screw, coil or auger. The handle 21 exerts a vertical pressure on the base when the fasteners are secured to the ground, thereby fixing the base in place. To this end, the handle 21 will often have a larger diameter than the helical portion 22.

In order to produce greater torque when screwing the fastener 5 into the ground, the handle 21 may include a flattened portion, an extension or an eyelet. The flattened portion is adapted to receive a wrench. The extension may be, for example, T-shaped or L-shaped. A pipe may even be slipped over the extension for greater torque. An elongated object, such as a bar, may be passed through the eyelet. The helical portion 22 must be strong enough to be screwed into the ground, but preferably, the helical portion 22 may be sufficiently flexible that underground obstructions, such as utility lines, may be detected without harm to the obstruction and the fastener 5 easily repositioned so as to avoid such obstructions. A flexible fastener that is inserted with low torque is less likely to puncture an underground obstruction, such as a gas line, water pipe or electrical line. Because a plurality of fasteners is used, the fasteners need not penetrate into the ground as deeply as a single fastener of the prior art. Preferably, the fasteners will penetrate into the ground no more than about nine inches. In contrast, conventional post anchors often exceed two or more feet and may even require concrete reinforcement.

Figure 3:
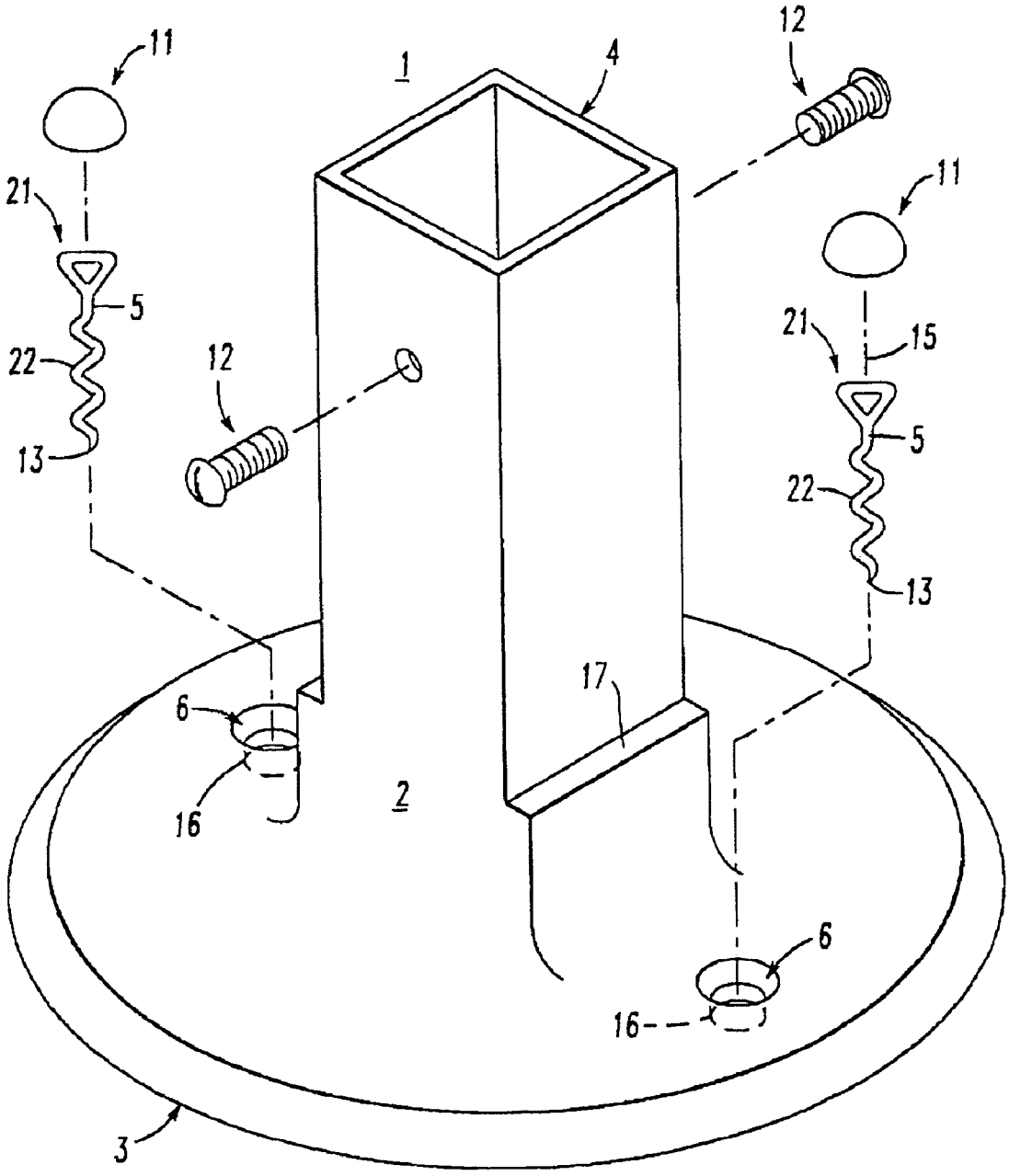
FIG. 3 is side perspective view of one embodiment of the invention.

FIG. 3 shows a first embodiment of the anchor 1. The anchor 1 comprises a base 2 including a central portion 4 surrounded by a disc-shaped skirt 3. The skirt includes three holes 6, two of which are visible in the figure. The fasteners 5 include helical coils 22 having a pointed end 13 and a handle 21. The handle 21 is shaped so that its rotation about the longitudinal axis 15 of the fastener 5 defines a frusto-conical shape. At least a section of the holes 6 have a recess 16 with a complimentary profile matching the shape defined by rotation of the handle 21. Engagement of the handle 21 with the recess 16 secures the base 2 to the ground. Optionally, a cap 111 may be placed over the handle 21 and hole 6. In this embodiment, the central portion 4 is rectangular in cross-section and includes an abutment 17 on which would rest the object to be secured. The abutment 17 should be on at least two sides of the central portion 4. The central portion 4 accepts a hollow, rectangular post. At least one interlock 12 secures the object to the central portion 4.

Figure 4:
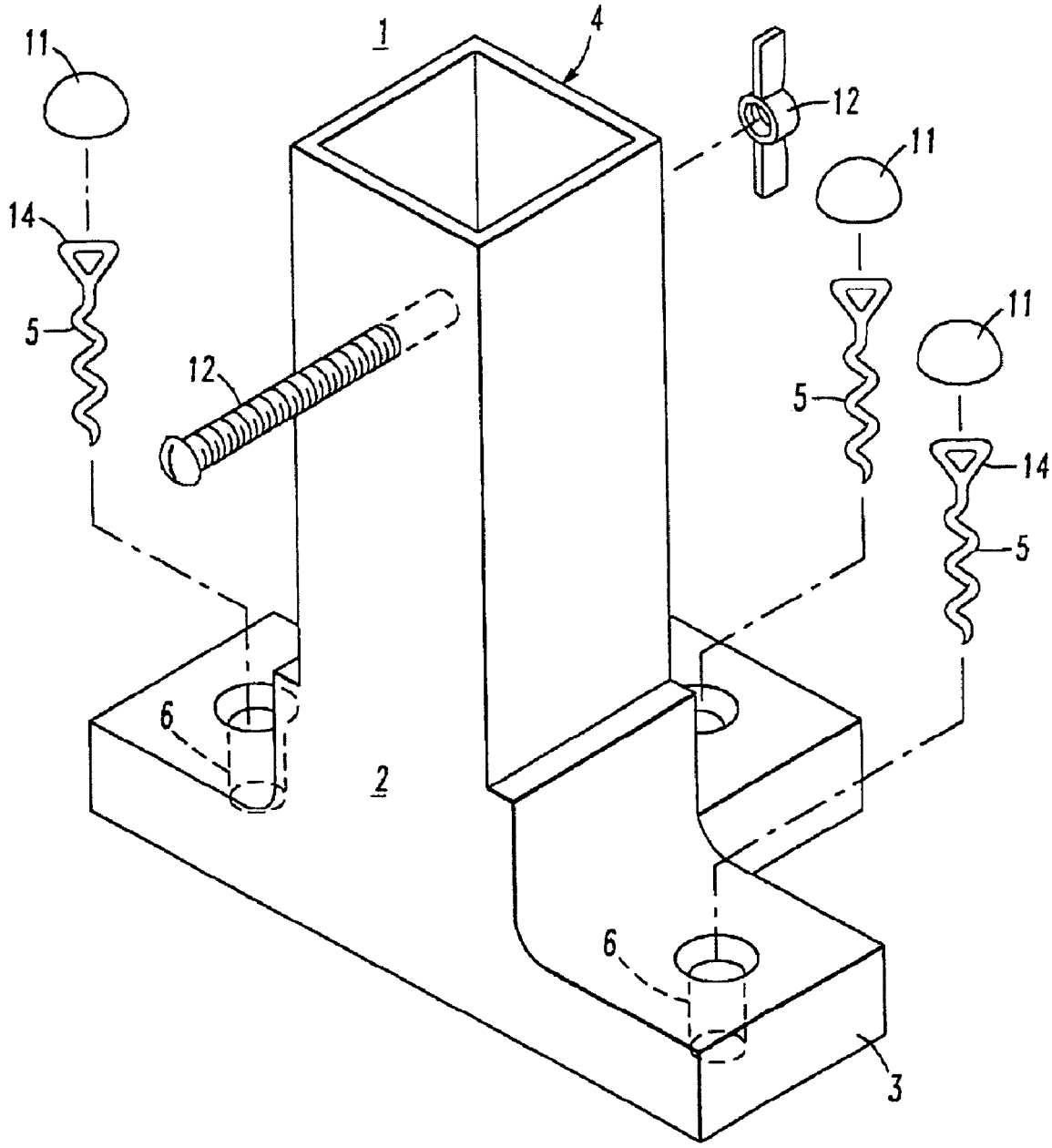
FIG. 4 is side perspective view of a second embodiment of the invention.

FIG. 4 shows a second embodiment of the anchor 1. The anchor 1 includes a base 2 having a central portion 4 surrounded by a plurality of legs 3. Each leg 3 defines a hole 6 through which a fastener 5 passes and secures the base 2 to the ground. The interlock 12 comprises a bolt and wing-nut. The use of a bolt and wing-nut permits securing the object to the anchor 1 without tools.

Figure 5:
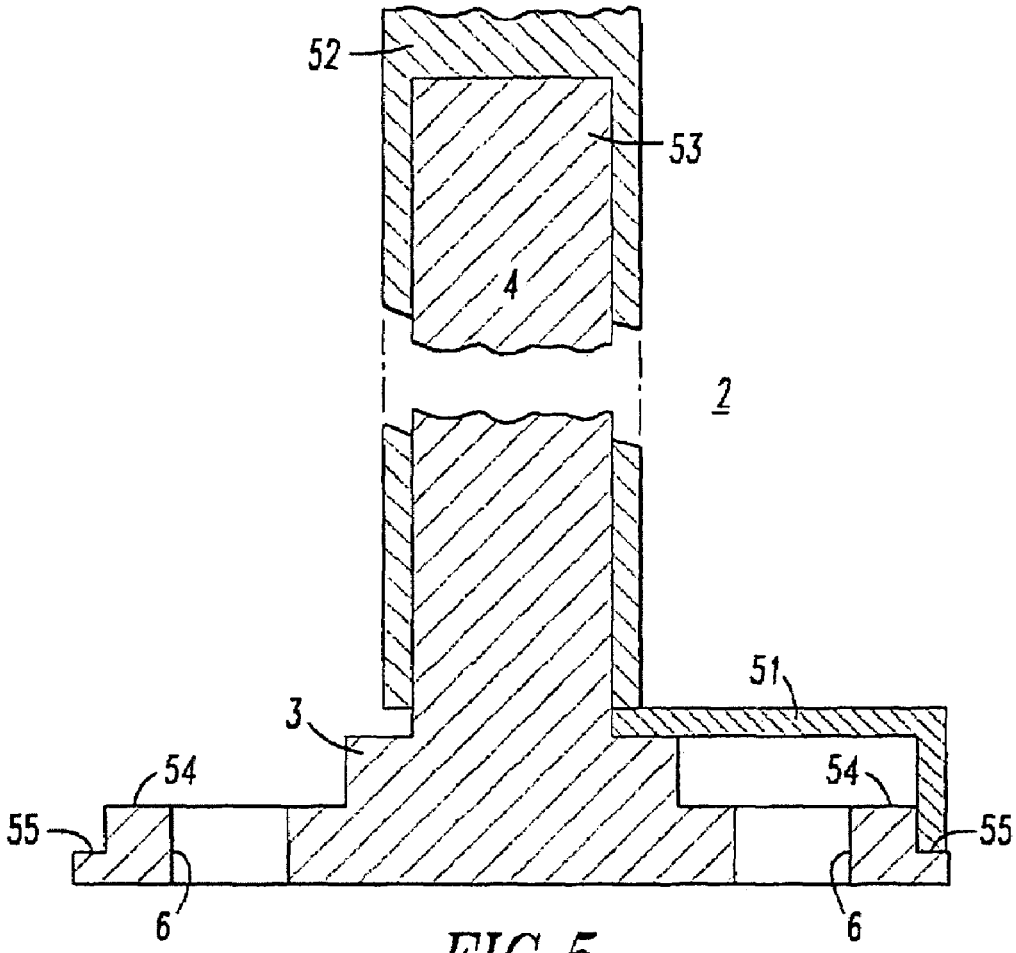
FIG. 5 is a cut-away side view of an anchor of the present invention.
Figure 6:
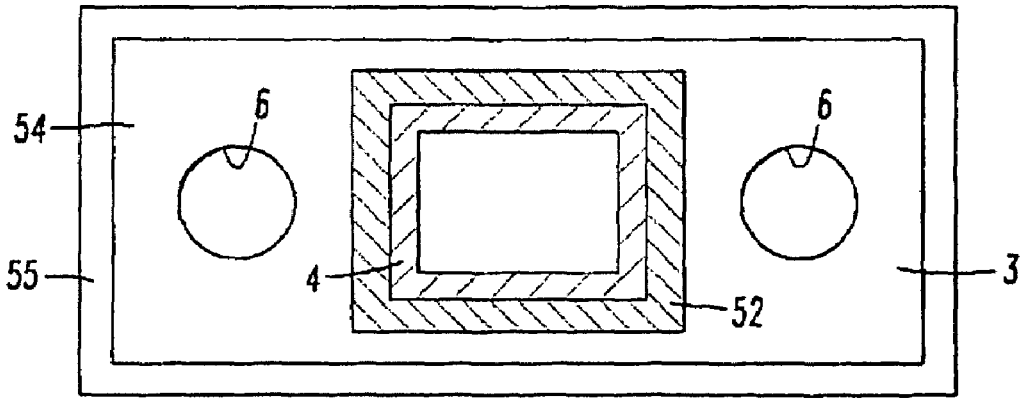
FIG. 6 is a top view of an anchor of the present invention.

A third embodiment of the invention is shown in FIGS. 5 and 6. The base 2 includes central portion 4 and a skirt 3 and has a flat bottom 7. The central portion comprises a tenon adapted to receive an object 52 having an end with a complimentary mortise 53. The skirt 3 defines two holes 6. Above the holes 6, the skirt has a flattened mounting area 54. In use, a fastener presses against the mounting area 54 to secure the base 2 to the ground. The fastener typically will include a washer. The skirt also includes a step 55. A cover 51 may cover at least a part of the skirt 3. As shown, the cover rests on the step 55. The cover 51 can be aesthetic and functional. For example, the cover 51 will channel water away from skirt and fasteners, thereby reducing corrosion. The cover 51 may conform to the shape of the skirt 3 and fasteners 5. Alternatively, the cover 51 may be of any desired color or shape.

Figure 7:
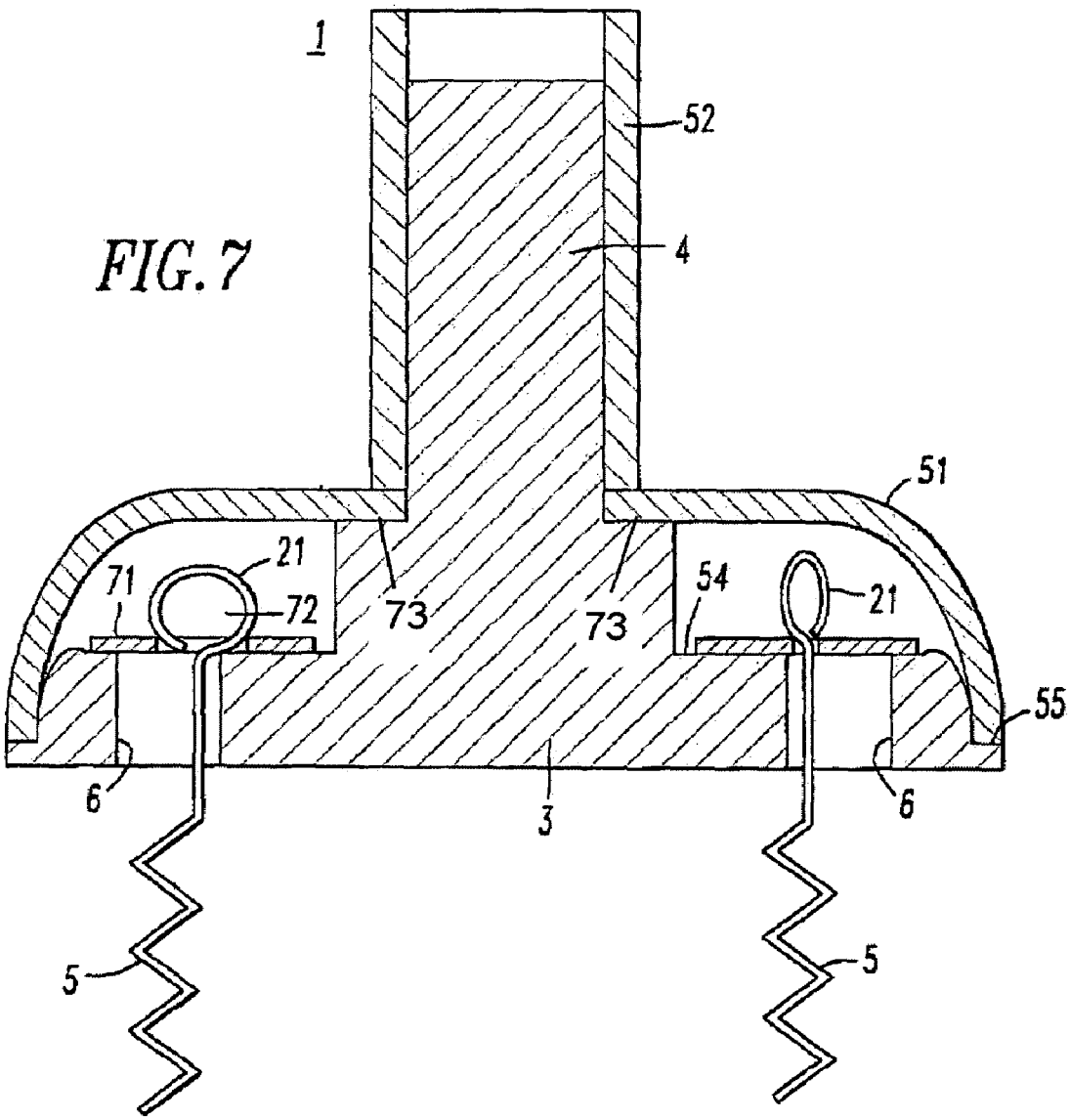
FIG. 7 is side view an anchor of the present invention having a cover.
Figure 8:
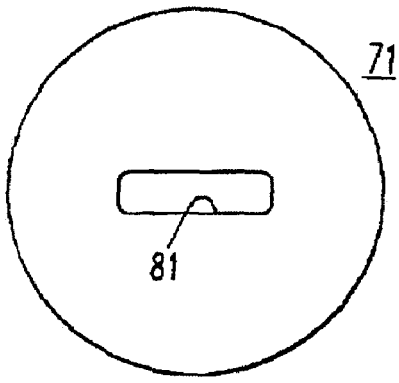
FIG. 8 is a washer for use in the present invention.

FIG. 7 shows an anchor 1 having a central portion 4 surrounded by a skirt 3. A fastener 5 passes through each hole 6 in the skirt 3. Washers 71 rest on the mounting area 54. The washers 71 are configured so that the handle 21 of the fastener 5 cannot pass therethrough. Preferably, as shown in FIG. 8, the washer 71 defines a slot 81 into which a bottom portion of the handle 21 will fit, thereby locking the fastener 5 in place. Advantageously, the handle 21 of the each fastener 5 includes an eyelet 72. An elongated object, such as a pipe or bar, may be slipped into the eyelet 72 so that greater torque can be applied to the fastener 5. A cover 51 fits over the skirt 3 and fasteners 5. The cover may comprise one or more pieces. A single piece cover 51 defines an opening large enough so that the cover 51 can be slipped over the central portion 4. A two-piece cover could be assembled around the central post 4. The outer perimeter of the cover 51 rests on a step 55. The inner perimeter of the cover 51 rests on an abutment 73 around the central portion 4. A mortised object 52 fits over the central portion 4 and holds the cover 51 against the abutment 73.

Obviously, numerous modifications and variations of the present invention are possible. It is, therefore, to be understood that within the scope of the following claims, the invention may be practiced otherwise than as specifically described. While this invention has been described with respect to certain preferred embodiments, different variations, modifications, and additions to the invention will become evident to persons of ordinary skill in the art. All such modifications, variations, and additions are intended to be encompassed within the scope of this patent, which is limited only by the claims appended hereto.

What is claimed:

1. An anchor for fixing an object to ground comprising:

a) a base having a central portion surrounded at least in part by a skirt, the central portion capable of receiving the object, the skirt defining a plurality of holes;

b) a plurality of fasteners, each fastener comprising a helical portion and a handle, the fasteners extending through the holes in the skirt and adapted to be screwed into the ground so that the handle presses against the skirt, thereby fixing the anchor to the ground; and c) a cover that covers at least a portion of the skirt, and the skirt includes a step around at least a portion of an outer perimeter and the cover rests on the step.

2. The anchor of claim 1, wherein the base includes a flat bottom.

3. The anchor of claim 1, wherein the central portion comprises at least one vertical flange for fixing the object to the flange.

4. The anchor of claim 1, wherein the central portion includes a box formed by a plurality of flanges and into which an end of the object may be placed.

5. The anchor of claim 1, wherein the central portion includes a tenon adapted to receive a mortise on the object.

6. The anchor of claim 1, wherein the central portion includes an interlock for fixedly securing the object.

7. The anchor of claim 6, wherein the interlock is selected from a group consisting of screws, bolts, rivets, glues, snaps, and springs.

8. The anchor of claim 1, wherein the skirt is selected from a group consisting of a disc, a plate, a frusto-conical element, and a plurality of legs.

9. The anchor of claim 1, wherein the holes in the skirt include a recess with a complimentary profile matching a shape defined by rotation of the handle of the fastener.

10. The anchor of claim 1, wherein the helical portion includes a first end attached to the handle and a second end including a point.

11. The anchor of claim 1, wherein the fastener includes a longitudinal axis along the helical portion and rotation of the handle about the longitudinal axis defines a frusto-conical shape.

12. The anchor of claim 1, wherein the helical portion includes at least one member selected from the group consisting of a screw, a coil and an auger.

13. The anchor of claim 1, wherein the handle includes a member for increasing torque on the fastener selected from the group consisting of a flattened portion, an L-shaped extension, a T-shaped extension, and an eyelet.

14. The anchor of claim 1, wherein the fastener includes a washer defining a slot and a bottom portion of the handle fits into the slot, thereby locking the fastener in place.

15. An anchor for fixing an object to ground comprising:

a) a base having a central portion surrounded at least in part by a skirt, the skirt defining a plurality of holes and including a step around at least a portion of an outer perimeter, the central portion capable of receiving the object and including an abutment;

b) a plurality of fasteners, each fastener comprising a helical portion and a handle, the fasteners extending through the holes in the skirt and adapted to be screwed into the ground so that the handle presses against the skirt, thereby fixing the anchor to the ground; and c) a cover that rests on the step and the abutment, and covers at least a portion of the skirt.

16. The anchor of claim 15, wherein the skirt is selected from a group consisting of a disc, a plate, a frusto-conical element, and a plurality of legs.

17. The anchor of claim 15, wherein the central portion includes an interlock for fixedly securing the object.

18. The anchor of claim 17, wherein the cover consists essentially of a single piece that fits over the fasteners, the object holds the cover against the abutment, and the interlock prevents the object from moving.

* * * * *